US011137130B1

(12) United States Patent
Dry et al.

(10) Patent No.: US 11,137,130 B1
(45) Date of Patent: Oct. 5, 2021

(54) VEHICLE LIGHTING ASSEMBLY CONDENSATION MANAGEMENT SYSTEM AND METHOD

(71) Applicant: Ford Global Technologies, LLC, Dearborn, MI (US)

(72) Inventors: Alan George Dry, Grosse Pointe Woods, MI (US); David A. Brown, Plymouth, MI (US); Brian Robert Spahn, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/009,085

(22) Filed: Sep. 1, 2020

(51) Int. Cl.
*F21S 45/30* (2018.01)
*F21S 45/60* (2018.01)
*F21V 17/16* (2006.01)

(52) U.S. Cl.
CPC ..... *F21S 45/60* (2018.01); *F21V 17/164* (2013.01)

(58) Field of Classification Search
CPC . F21S 45/33; F21S 45/30; F21S 45/60; B01D 53/26; B60Q 1/0005
See application file for complete search history.

(56) References Cited

U.S. PATENT DOCUMENTS 4,809,144 A * 2/1989 Suzuki ..... F21S 45/33 362/547
5,230,719 A * 7/1993 Berner ..... F24F 12/001 96/144
6,422,729 B1 * 7/2002 Rohrbach ..... F21S 48/335 362/539
6,495,222 B1 * 12/2002 Mosser ..... F21S 48/335 362/294
6,709,493 B2 * 3/2004 DeGuiseppi ..... B01D 53/261 96/7
6,883,948 B2 * 4/2005 VanDuyn ..... F21S 45/33 362/547
9,068,713 B2 * 6/2015 Yang ..... F21S 45/48
10,156,372 B2 12/2018 Keough et al.
10,386,059 B2 * 8/2019 Furuuchi ..... F21S 45/33
10,458,640 B2 * 10/2019 Tezuka ..... F21V 31/005
10,648,639 B2 * 5/2020 Park ..... F21S 45/33
2009/0268475 A1 * 10/2009 Ball ..... F21S 45/33 362/373

(Continued)

FOREIGN PATENT DOCUMENTS

DE 102006006099 8/2007

OTHER PUBLICATIONS

Wang, Jinlong, et al., Water Harvesting from the Atmosphere in Arid Areas with Manganese Dioxide, Environ. Sci. Technol. Lett. 2020, 7, 48-53.

(Continued)

*Primary Examiner* — Ismael Negron
(74) *Attorney, Agent, or Firm* — David Coppiellie, Esq.; Carlson, Gaskey & Olds, P.C.

(57) ABSTRACT

A condensation management system includes a vehicle lighting assembly with an interior vented to an ambient environment through a conduit, a moisture control assembly with a desiccant assembly positioned such that air passing through the conduit passes through the desiccant assembly, and a heater for heating the desiccant assembly in response to a difference between the interior and the ambient environment.

19 Claims, 4 Drawing Sheets

(56) References Cited

U.S. PATENT DOCUMENTS

| | | | | |
|---|---|---|---|---|
| 2011/0222305 | A1* | 9/2011 | Huang | F21S 45/60<br>362/520 |
| 2015/0055944 | A1* | 2/2015 | Van Straten | H05B 3/16<br>392/426 |
| 2019/0126234 | A1 | 5/2019 | Flaugher et al. | |
| 2019/0255482 | A1 | 8/2019 | Ball et al. | |

OTHER PUBLICATIONS

Fathieh, Farhad, et al., Practical water production from desert air, Sci. Adv. 2018;4: eaat3198 Jun. 8, 2018.

* cited by examiner

VEHICLE LIGHTING ASSEMBLY CONDENSATION MANAGEMENT SYSTEM AND METHOD

TECHNICAL FIELD

This disclosure relates generally to reducing condensation within an interior of a vehicle lighting assembly, such as a headlamp.

BACKGROUND

A vehicle lighting assembly can have an interior that vents to an ambient environment. Condensation can build up within the interior.

SUMMARY

A condensation management system for a vehicle according to an exemplary aspect of the present disclosure includes, among other things, a lighting assembly for a vehicle, and a conduit that opens to an interior of the lighting assembly. The interior of the lighting assembly is vented to an ambient environment through the conduit. The system further includes a moisture control assembly that includes a desiccant assembly and a heater. The desiccant assembly is positioned such that air communicated through the conduit passes through the desiccant assembly. The heater is configured to activate to heat the desiccant assembly in response to a difference between the interior and the ambient environment.

In another example of the foregoing system, the lighting assembly is a vehicle headlamp.

Another example of any of the foregoing systems includes a hose providing the conduit. The hose extends from the lighting assembly to the moisture control assembly.

Another example of any of the foregoing systems includes a housing of the moisture control assembly. The housing holds the desiccant assembly and the heater.

In another example of any of the foregoing systems, the housing is secured directly to the lighting assembly. The conduit is provided by the moisture control assembly, the lighting assembly, or both.

In another example of any of the foregoing systems, the housing is snap-fit to the lighting assembly.

In another example of any of the foregoing systems, the desiccant assembly includes a desiccant within a mesh container.

In another example of any of the foregoing systems, the desiccant is birnessite.

In another example of any of the foregoing systems, the heater is provided using thermal energy from a radiator of the vehicle.

In another example of any of the foregoing systems, the vehicle is an electrified vehicle having a traction battery, and the heater is provided by a traction battery cooling system.

In another example of any of the foregoing systems, the heater includes a heating element that is disposed within the conduit such that air communicated through the conduit passes over the heating element.

Another example of any of the foregoing systems includes an interior pressure sensor and an exterior pressure sensor. The interior pressure sensor is configured to sense a pressure on a first side of the desiccant assembly. The exterior pressure sensor is configured to sense a pressure on an opposite second side of the desiccant assembly. The heater is configured to activate in response to the pressure on the first side being higher than the pressure on the second side.

In another example of any of the foregoing systems, the heater is configured to activate in response to a pressure within the interior being higher than a pressure outside the interior.

In another example of any of the foregoing systems, the heater is configured to activate in response to a temperature within the interior being higher than a temperature of the ambient environment.

Another example of any of the foregoing systems includes a control module configured to transition a switch to activate the heater. The control module transitions the switch in response to the difference between the interior and the ambient environment.

A condensation management method according to another exemplary aspect of the present disclosure includes, among other things, activating a heater when air is moving from an interior of a lighting assembly to an ambient environment. The heater heating a desiccant assembly and air moving from the interior to the desiccant assembly when the heater is activated. The method further includes deactivating the heater when air is moving from the ambient environment to the lighting assembly.

In another example of the foregoing method, the lighting assembly is a headlamp.

In another example of any of the foregoing methods, air flows through a conduit when moving between the interior and the ambient environment. The desiccant assembly and the heater are both at least partially disposed within the conduit.

In another example of any of the foregoing systems, the heater is deactivated in response to a pressure difference between the interior and the ambient environment.

In another example of any of the foregoing systems, the heater is deactivated in response to a temperature difference between the interior and the ambient environment.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure details a system and method for managing condensation within a vehicle lighting assembly. The lighting assembly can be a headlamp, for example. The system and method can involve venting air from an interior of the headlamp over a desiccant material. A heater can selectively heat the desiccant. The heater can be configured to heat in response to a temperature or pressure difference between the interior of the lighting assembly and an ambient environment. Selective heating can help to reduce an amount of condensation within the headlamp.

Figure 1:
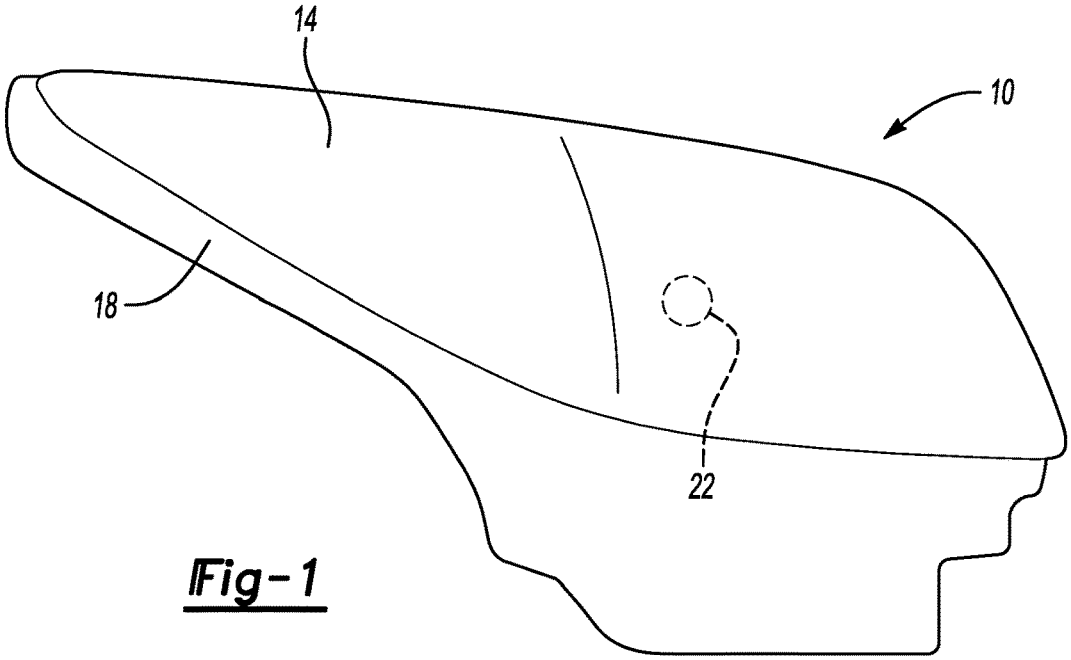
FIG. 1 shows a perspective view of a vehicle lighting assembly according to an exemplary aspect of the present disclosure.

With reference to FIG. 1, an exemplary vehicle lighting assembly is a lighting assembly 10 that includes a lens 14 and a housing 18. A light 22 can be activated to emit light through the lens 14 of the lighting assembly 10. The lighting assembly 10 can be a passenger side headlamp for a vehicle. In this example, the vehicle is an electrified vehicle that has a traction battery configured to selectively power an electric machine that drives wheels of the vehicle. In another example, the lighting assembly 10 is a taillamp or illuminated signage of the vehicle. The illuminated signage could identify the vehicle, display advertisements, or both. The lighting assembly 10 could be located virtually anywhere on the vehicle.

Figure 2:
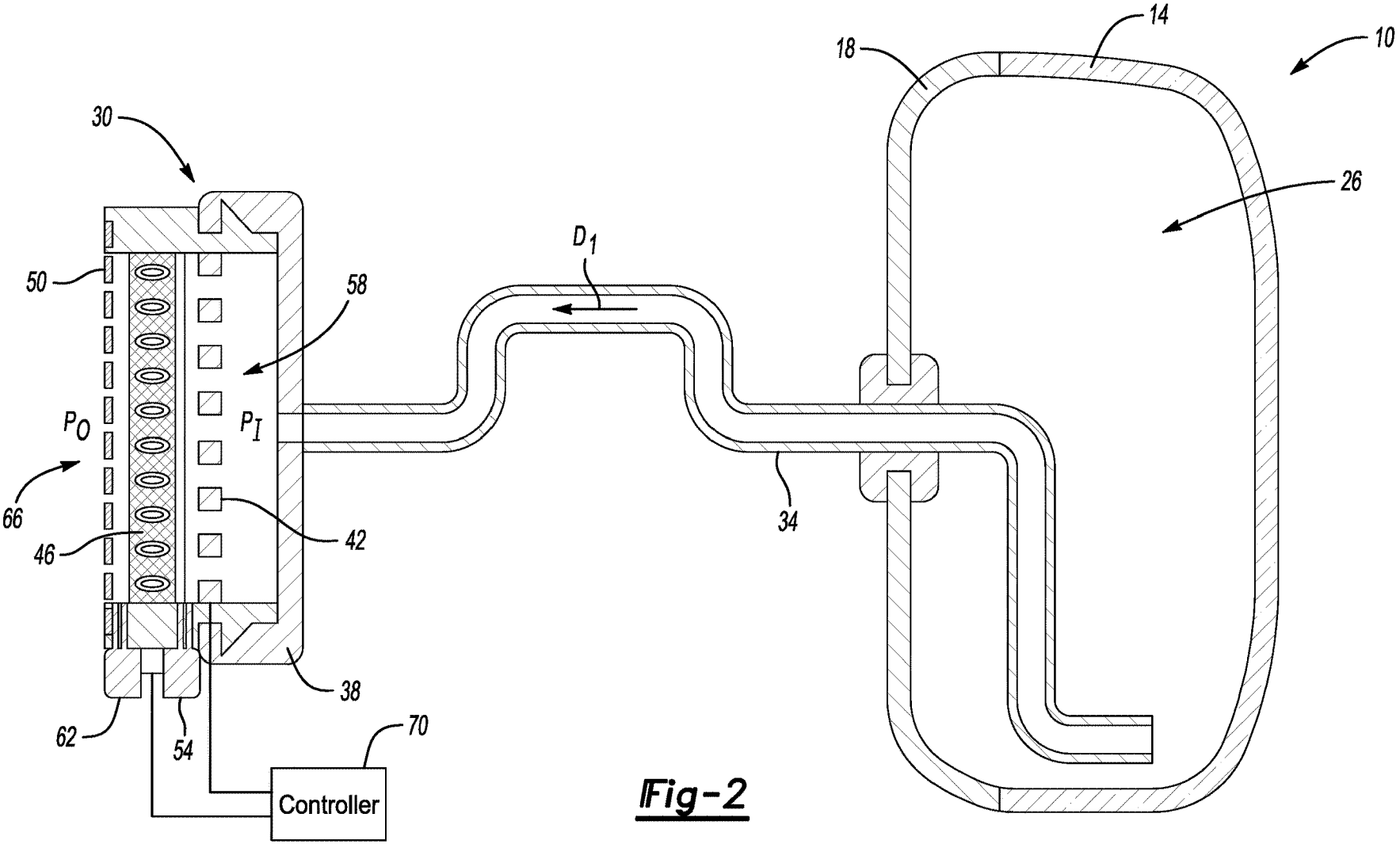
FIG. 2 shows a schematic section view of the vehicle lighting assembly of FIG. 1 along with a moisture control assembly operating according to first operating conditions.

With reference now to FIG. 2, the interior 26 of the lighting assembly 10 is provided between the lens 14 and the housing 18. As can be appreciated, excess condensation can be visible through the lens 14 and can potentially introduce functionality issues.

A condensation management system is relied on to reduce condensation within the interior 26. The condensation management system, in the exemplary embodiment, includes the lighting assembly 10, a moisture control assembly 30, and a conduit 34. The interior 26 of the lighting assembly 10 vents to an ambient environment through the conduit 34. That is, the conduit 34 communicates air to and from the interior 26.

The exemplary conduit 34 opens to the interior 26 of the lighting assembly 10, and extends from the interior 26 to the moisture control assembly 30. The moisture control assembly 30 is positioned such that air that moves through the conduit 34 to the interior 26 passes through the moisture control assembly 30. Further, air vented from the interior 26 through the conduit 34 to the ambient environment passes through the moisture control assembly 30.

The conduit 34 can be, for example, a tube having a six millimeter outside diameter. The tube can plug onto a nipple of a sealed connector plate that snaps into a standard vent aperture in a carrier structure associated with the lighting assembly 10. The other end of the connector tube can then plug onto a nipple of the moisture control assembly 30. In this manner both the moisture control assembly 30 and the lighting assembly 10 can be freely located wherever required on the vehicle. The moisture control assembly 30 could be associated with the lighting assembly 10 along with other lighting assemblies of the vehicle, such as a driver side headlamp.

The moisture control assembly 30 includes, among other things, a housing 38, a heater 42, a desiccant assembly 46, and a membrane filter 50. The heater 42, in the exemplary embodiment, includes at least one heating element that is disposed within the conduit 34 such that air communicated through the conduit 34 passes over the heating element.

The desiccant assembly 46, in the exemplary embodiment, includes a desiccant material held within a mesh container, such as a mesh bag. The mesh bag contains the desiccant while permitting air to move through the desiccant assembly 46 across the desiccant material. The desiccant material can be a birnessite material, for example. In other examples, the desiccant can be a metal organic framework (MOF), zeolite, silica gel, or some combination of these.

The moisture control assembly 30 further incorporates a first pressure sensor 54 that can measure a pressure on a first side 58 of the desiccant assembly 46 and a second pressure sensor 62 that can measure a pressure on an opposite, second side 66 of the desiccant assembly 46. In an example, the first pressure sensor 54 is considered an interior pressure sensor and the second pressure sensor 62 is considered an exterior pressure sensor.

Generally, the pressure on the first side 58 is an interior pressure Pi corresponding to a pressure within the interior 26. The pressure measured by the second pressure sensor 62 is an ambient air pressure or an outside pressure Po, which is a pressure on the second side 66 of the desiccant.

The first pressure sensor 54, the second pressure sensor 62, and the heater 42 can be operably connected to a controller 70, which may be located remote from the moisture control assembly 30. The controller 70 can be programed to selectively activate the heater 42. The controller 70 can, for example, transition as switch to activate the heater 42. The controller 70 can activate the heater 42 in response to various inputs. The activation can be, in part, based on information and data from the first pressure sensor 54 and the second pressure sensor 62.

In FIG. 2, the moisture control assembly 30 is shown operating according to first operating conditions where a pressure reading from the first pressure sensor 54 is higher than a pressure reading from the second pressure sensor 62. This indicates that a pressure within the interior 26 is higher than a pressure of the exterior. When the pressure within the interior 26 is higher than a pressure of the ambient environment, the pressure imbalance causes air to vent from the interior 26 through the conduit 34 toward the moisture control assembly 30 in the direction $D_1$. In the exemplary embodiment, the controller 70 activates the heater 42 when a pressure measured by the first pressure sensor 54 is higher than a pressure measured by the second pressure sensor 62. That is, the heater 42 is activated when air is venting from the interior 26.

In response to being heated, a desiccant material can release moisture. In the exemplary embodiment, the desiccant material within the desiccant assembly 46 releases moisture when heated by the heater 42. Because the desiccant material is heated when the flow of air is moving in the direction D, moisture released by the desiccant assembly 46 is carried by the moving air and into the ambient environment. The moisture release by the desiccant assembly 46 is released as gaseous moisture and can pass through the membrane filter 50 to the ambient environment.

Figure 3:
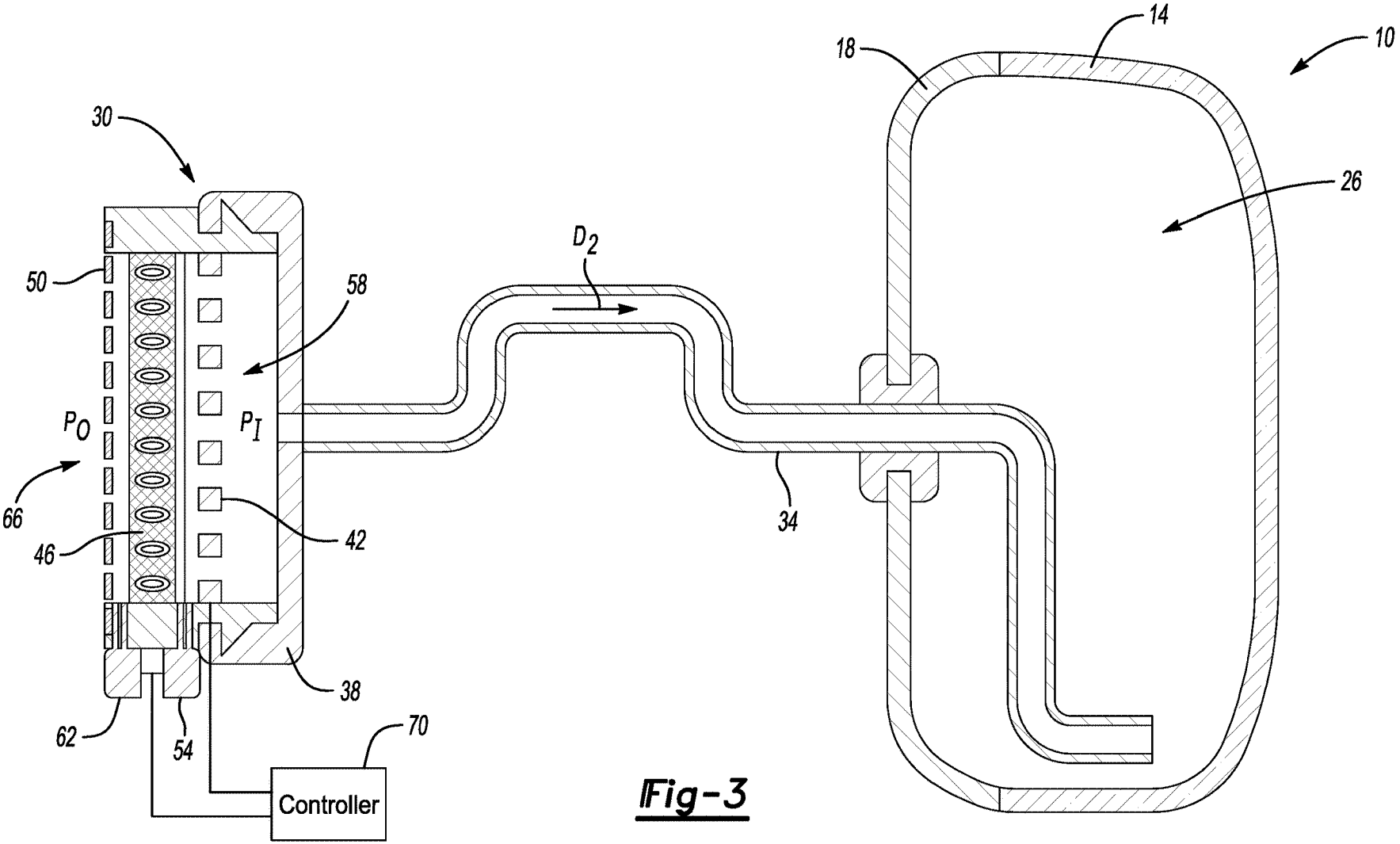
FIG. 3 shows the vehicle lighting assembly and moisture control assembly of FIG. 2 operating according to different, second operating conditions.

With reference now to FIG. 3, the moisture control assembly 30 is shown operating according to second operating conditions where a pressure reading from the second pressure sensor 62 is higher than the pressure reading from the first pressure sensor 54. This indicates that a pressure within the interior 26 is lower than a pressure of the ambient environment. This pressure imbalance causes the flow of air to moving through the conduit 34 in the direction $D_2$ from the ambient environment into the interior 26.

In response to the pressure reading from the first pressure sensor 54 being lower than the pressure reading from the second pressure sensor 62, the heater 42 is deactivated. Accordingly, the desiccant material within the desiccant assembly 46 is not heated by the heater 42, which makes the desiccant material less likely to release moisture.

As air moves through the conduit 34 into the moisture control assembly 30 in the direction $D_2$, the air initially moves through the membrane filter 50. The membrane filter 50 can be a material that blocks liquid moisture and dust, but permits gaseous moisture to pass. Membrane filtering materials sold under the trademark GORE-TEX are used in some examples. Notably, the cross-sectional area of the moisture control assembly 30 available for flow to pass is larger than the area available for flow to move through the housing 18. This can facilitate enhanced moisture removal from the flow through the moisture control assembly 30 due to the surface area of desiccant available to interface with the flow through the moisture control assembly 30.

The membrane filter 50 blocks liquid moisture within the ambient environment from entering the conduit 34 and passing into the interior 26 of the lighting assembly 10. Thus, after the air has passed through the membrane filter 50, the moisture carried by the air is gaseous moisture.

The air carrying gaseous moisture moves from the membrane filter 50 through the desiccant assembly 46. As the air passes through the desiccant assembly 46, the desiccant material within the desiccant assembly 46 absorbs gaseous moisture. Thus, the flow of air on the first side 58 of the desiccant assembly 46 contains less moisture than the flow of air on the second side 66 of the desiccant assembly 46.

After passing through the desiccant assembly 46, the air, which contains less moisture than the air of the ambient environment, can then move through the remaining portions of the conduit 34 into the interior 26. Because the air is relatively dry, the amount of condensation within the interior 26 is reduced when compared to moving air directly from the ambient environment to the interior 26.

Figure 4:
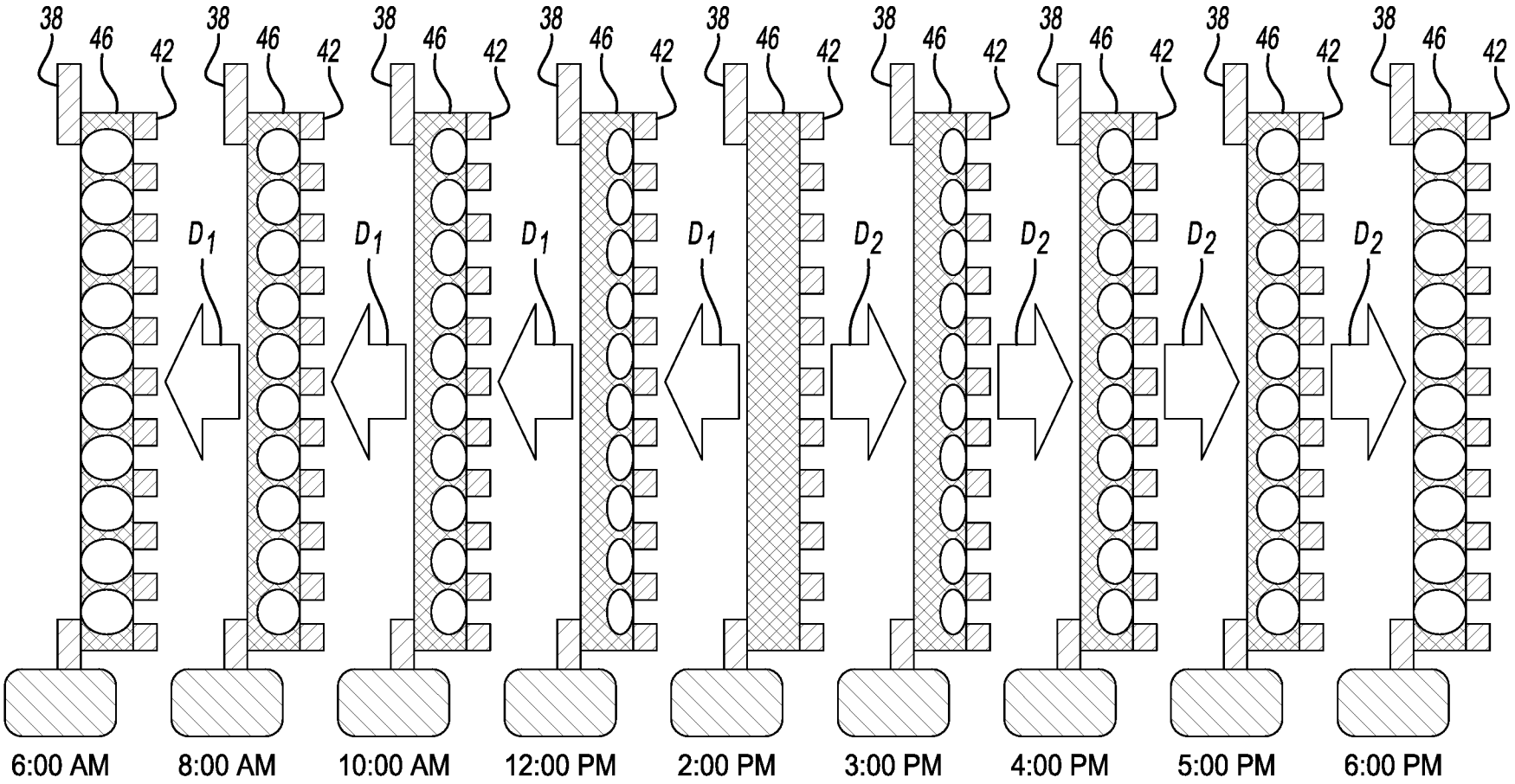
FIG. 4 shows a section view of the moisture control assembly of FIG. 2 at different times.

With reference now to FIG. 4 and continuing reference to FIG. 3, the heater 42 and desiccant assembly 46 are shown at selected times beginning at a start time of 6:00 AM and ending at an end time of 6:00 PM. In this example, the ambient temperature increases from 6:00 AM until about 2:00 PM, and then decreases until 6:00 PM.

At 6:00 AM, the ambient temperature and the temperature within the interior 26 are about the same. Thus, there is no substantial temperature or pressure difference between the interior 26 and the ambient environment, and substantially no flow through the desiccant assembly 46.

As the sun rises, the temperature within the interior 26 increases. The heating of the interior 26 causes air to vent from the interior 26 through the desiccant assembly 46 in the direction $D_1$ from 8:00 AM until about 2:00 PM. The heater 42 is activated during these times to encourage the desiccant material within the desiccant assembly 46 to release moisture so that this moisture can be expelled into the ambient environment. The controller 70 activates the heater 42 in response to information about the pressure increasing within the interior 26.

At 3:00 PM, the interior 26 begins to cool. Accordingly, flow through the desiccant assembly reverses and moves in the direction $D_1$ into the interior 26 from the ambient environment. In response to the change in pressure, the change in temperature, or both, the controller 70 deactivates the heater 42 so that the desiccant assembly 46 is no longer heated by the heater 42. Removing the heating of the desiccant material facilitates the ability of the desiccant material to capture moisture moved through the desiccant assembly 46.

Figure 5:
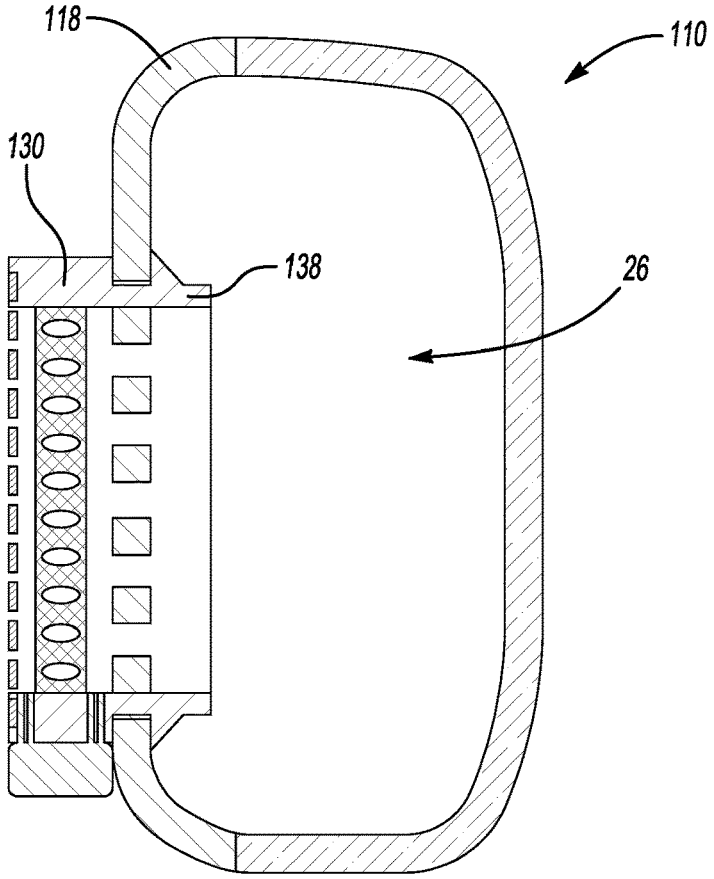
FIG. 5 shows a section view of the lighting assembly of FIG. 1 and a moisture control assembly according to another exemplary aspect of the present disclosure.

FIG. 5 illustrates a moisture control assembly 130 according to another exemplary aspect of the present disclosure. The moisture control assembly 130 is secured directly to the lighting assembly 110.

In this example, a housing 138 of the moisture control assembly 130 is snap-fit or clipped to the housing 118 of the lighting assembly 110. The conduit communicating air to and from the interior 26 is thus provided by the housing 138 of the moisture control assembly 130 rather than the conduit 34 being provided by a separate hose, as shown in the embodiment of FIGS. 2 and 3.

In yet another example, the moisture control assembly 130 could be disposed within the interior 26 of the lighting assembly 110.

The embodiment of FIGS. 2 and 3, with the hose, may be used when positioning the moisture control assembly 30 remotely from the lighting assembly 10. This can be useful to, for example, address packaging issues. However, the remote positioning of the moisture control assembly 30 is not required as shown by the moisture control assembly 130. Clipping or otherwise securing the moisture control assembly 130 directly to the lighting assembly 10 can eliminate the need for the separate hose.

Referring again to the embodiment of FIGS. 2 and 3, positioning the moisture control assembly 30 remotely from the lighting assembly 10 may facilitate the use of particular heat sources within the vehicle to provide thermal energy as the heater 42. For example, the heater 42 could utilize thermal energy generated by a traction battery cooling system associated with the vehicle. Positioning the moisture control assembly 30 near the traction battery cooling system that is providing the thermal energy may be beneficial. In another example, the heater 42 is provided using thermal energy from a radiator of the vehicle.

There are many sources of thermal energy within the vehicle. The heater 42 can utilize these sources of thermal energy and may be position remotely from the lighting assembly 10 near these sources of thermal energy.

Features of the disclosed examples include a condensation management system and management method that can reduce an absolute humidity level within an interior of a lighting assembly. By reducing the absolute humidity, the interior of the lighting assembly is less likely to reach a dew point at which condensation would form within the interior. The condensation management system and method can achieve the reduction in absolute humidity within the interior without necessarily requiring replaceable desiccants, heat pumps, or fans. The condensation management system and method, in some examples, have no specific moving parts which can reduce overall build complexity.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A lighting assembly for a vehicle, comprising:

a lighting assembly housing defining an interior;

a conduit that opens to the interior of the housing, the interior vented to an ambient environment surrounding the housing through the conduit; and a moisture control assembly that includes a desiccant assembly and a heater, the desiccant assembly positioned such that air flowing through the conduit passes through the desiccant assembly, the heater configured to activate to heat the desiccant assembly in response to a difference between conditions in the interior and the ambient environment, wherein the heater is provided using thermal energy from a radiator of the vehicle.

2. The lighting assembly of claim 1, wherein the lighting assembly is a vehicle headlamp.

3. The lighting assembly of claim 1, further comprising a hose providing the conduit, the hose extending from the lighting assembly to the moisture control assembly.

4. A vehicle including the lighting assembly of claim 1, wherein the vehicle is an electrified vehicle having a traction battery, and the heater is provided by a traction battery cooling system.

5. The lighting assembly of claim 1, wherein the heater includes a heating element that is disposed within the conduit such that air communicated through the conduit passes over the heating element.

6. The lighting assembly of claim 1, further comprising an interior pressure sensor and an exterior pressure sensor, the interior pressure sensor configured to sense a pressure on a first side of the desiccant assembly, the exterior pressure sensor configured to sense a pressure on an opposite second side of the desiccant assembly, the heater is configured to activate in response to the pressure on the first side being higher than the pressure on the second side.

7. The lighting assembly of claim 1, wherein the heater is configured to activate in response to a pressure within the interior being higher than a pressure outside the interior.

8. The lighting assembly of claim 1, wherein the heater is configured to activate in response to a temperature within the interior being higher than a temperature of the ambient environment.

9. The lighting assembly of claim 1, further comprising a control module configured to transition a switch to activate the heater, the control module transitioning the switch in response to the difference between the interior and the ambient environment.

10. The lighting assembly of claim 1, wherein the desiccant assembly includes a desiccant within a mesh container.

11. The lighting assembly of claim 10, wherein the desiccant is birnessite.

12. The lighting assembly of claim 1, further comprising a housing of the moisture control assembly, the housing of the moisture control assembly holding the desiccant assembly and the heater.

13. The lighting assembly of claim 12, wherein the housing is secured directly to the lighting assembly, the conduit is provided by the moisture control assembly, the lighting assembly, or both.

14. The lighting assembly of claim 12, wherein the housing is snap-fit to the lighting assembly.

15. A condensation management method, comprising:

activating a heater when air is moving from an interior of a lighting assembly to an ambient environment, the heater heating a desiccant assembly and air moving from the interior to the desiccant assembly when the heater is activated; and deactivating the heater when air is moving from the ambient environment to the lighting assembly, wherein the heater is provided using thermal energy from a radiator of the vehicle, or using thermal energy from a traction battery cooling system.

16. The condensation management method of claim 15, wherein the lighting assembly is a headlamp.

17. The condensation management method of claim 15, wherein air flows through a conduit when moving between the interior and the ambient environment, the desiccant assembly and the heater both at least partially disposed within the conduit.

18. The condensation management method of claim 15, wherein the heater is deactivated in response to a pressure difference between the interior and the ambient environment.

19. The condensation management method of claim 15, wherein the heater is deactivated in response to a temperature difference between the interior and the ambient environment.

* * * * *